US006576853B2

(12) United States Patent
Motojima

(10) Patent No.: US 6,576,853 B2
(45) Date of Patent: Jun. 10, 2003

(54) SWITCH EXHIBITION NON-UNIDIRECTIONAL DISPLACEMENT

(75) Inventor: Joe Motojima, Akishima (JP)

(73) Assignee: Japan Aviation Electronics Industry, Limited, Shibuya-Ku (JP)

( * ) Notice: Subject to any disclaimer, the term of this patent is extended or adjusted under 35 U.S.C. 154(b) by 0 days.

(21) Appl. No.: 10/012,953

(22) Filed: Dec. 7, 2001

(65) Prior Publication Data

US 2002/0079202 A1 Jun. 27, 2002

(30) Foreign Application Priority Data

Dec. 7, 2000 (JP) ..... 2000-373004

(51) Int. Cl.[7] ..... H01R 13/05

(52) U.S. Cl. ..... 200/51.09; 200/283; 439/188; 439/630

(58) Field of Search ..... 200/51 R, 51.09, 200/239–242, 252, 253, 283, 284, 292; 439/188, 630

(56) References Cited

U.S. PATENT DOCUMENTS 5,924,881 A * 7/1999 Yasushi et al. ..... 439/188
6,159,028 A * 12/2000 Bernardet et al. ..... 439/188
6,326,568 B2 * 12/2001 Martucci et al. ..... 200/283
6,409,546 B1 * 6/2002 Ito et al. ..... 439/630

* cited by examiner

*Primary Examiner*—Michael Friedhofer
(74) *Attorney, Agent, or Firm*—Michael Best & Friedrich LLC

(57) ABSTRACT

In a switch having first and second contacts, a first contacting portion of the first contact is movable in a first direction alone while a second contacting portion of the second contact is movable only in a second direction intersecting with the first direction. The first contacting portion is supported by a first spring portion. The second contacting portion is supported by a second spring portion and faced to the first contacting portion in the first direction to be brought into contact with the first contacting portion with the second spring portion being bent. The first and the second contacting portions are in a mutual relationship such that, when the first contacting portion is press-contacted by the second contacting portion in the first direction, the second contacting portion is applied with component force in the second direction.

13 Claims, 3 Drawing Sheets

SWITCH EXHIBITION NON-UNIDIRECTIONAL DISPLACEMENT

BACKGROUND OF THE INVENTION

This invention relates to a switch and a connector using the same.

Recently, various cards are widely spread and conveniently used. Following the spread of the cards, development is made of various types of card connectors for handling or connecting these cards. Such card connector may have a card detecting function, a simplified card locking function, a write protect function, and so on. These functions can be realized by providing the card connector with a switch operable upon insertion of the card.

Generally, the switch of the type comprises first and second contacts having elasticity and faced to each other in a predetermined direction with a space left therebetween. When the first contact is pressed by the card or the like to be bent towards the second contact in the predetermined direction, the first contact touches the second contact. When the first contact is further bent so as to obtain a so-called wiping function, the second contact is also bent in the same direction or the predetermined direction in frictional contact with the first contact. In this structure, it is necessary to allow or accommodate not only the bending movement of the first contact but also the bending movement of the second contact. Therefore, a large space must be reserved in the predetermined direction.

In case where a large bending movement is required, a difference in reaction force of the first and the second contacts between a maximum bending state and a minimum bending state is increased. This results in an increase in physical damage of the contacts due to the stress or the like.

SUMMARY OF THE INVENTION

It is therefore an object of this invention to provide a switch capable of saving a space although a contact can be bent in a sufficiently large amount.

It is another object of this invention to provide a switch capable of reducing a difference in reaction force between a minimum bending state and a maximum bending state even if a large bending movement is required.

It is still another object of this invention to provide a connector using the above-mentioned switch.

Other objects of the present invention will become clear as the description proceeds.

According to an aspect of the present invention, there is provided a switch which comprises a first and a second contact, the first contact including a first contacting portion and a first spring portion supporting the first contacting portion so that the first contacting portion is movable in a first direction alone, the second contact including a second contacting portion faced to the first contacting portion in the first direction and adapted to be brought into contact with the first contacting portion and a second spring portion supporting the second contacting portion so that the second contacting portion is movable only in a second direction intersecting with the first direction, the first and the second contacting portions being in a mutual relationship such that, when the first contacting portion is press-contacted by the second contacting portion in the first direction, the second contacting portion is applied with component force in the second direction.

According to another aspect of the present invention, there is provided a connector which comprises the above-mentioned switch and an insulator supporting the switch.

According to still another aspect of the present invention, there is provided a switch comprising a first and a second contact which are adjacent to each other and extend in a predetermined direction. The first contact includes a first spring portion formed into a generally plate-like shape and a first contacting portion to be brought into contact with the second contact. The second contact includes a second spring portion formed into a generally plate-like shape and a second contacting portion to be brought into contact with the first contacting portion. The first and the second spring portions are arranged adjacent to each other so as to have a generally L-shaped section along a plane perpendicular to the predetermined direction. The first contacting portion is displaced in a first direction intersecting with the predetermined direction to press the second contacting portion so that the second contacting portion is displaced in a second direction intersecting with the predetermined direction and the first direction. The first and the second contacting portions are brought into frictional contact with each other during the displacement.

DESCRIPTION OF THE PREFERRED EMBODIMENT

Figure 1:
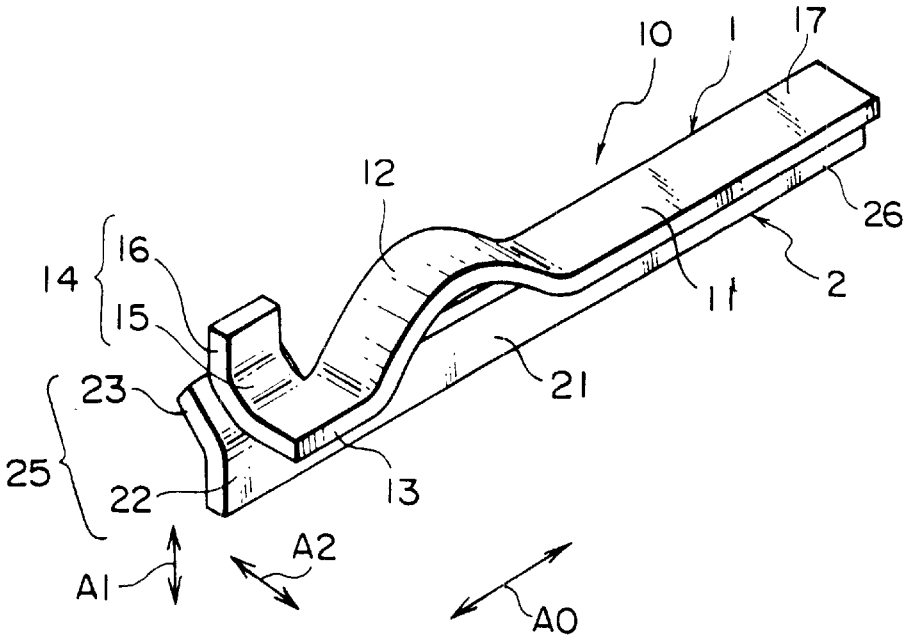
FIG. 1 is a perspective view of a switch according to an embodiment of this invention.
Figure 2:
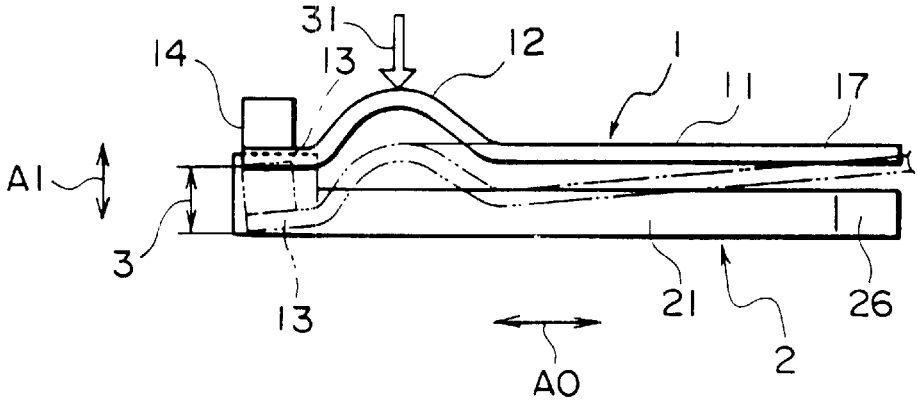
FIG. 2 is a side view of the switch illustrated in FIG. 1.
Figure 3:
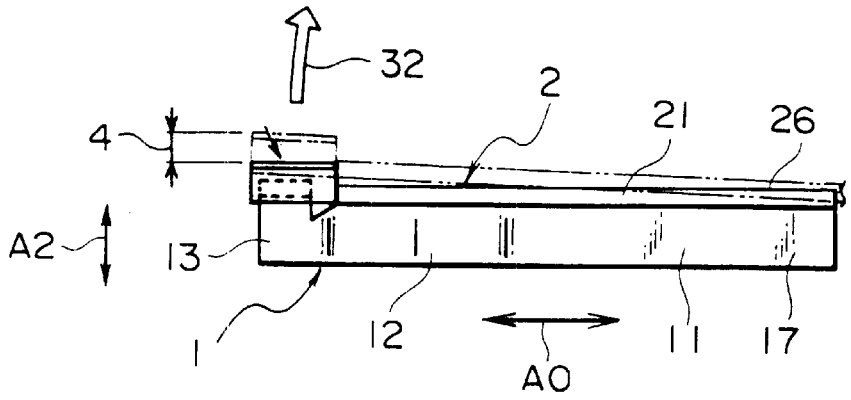
FIG. 3 is a plan view of the switch illustrated in FIG. 1.

Referring to FIGS. 1 through 3, description will be made of a switch according to an embodiment of this invention.

The switch illustrated in the figure is depicted by a reference numeral 10 and may also be called a non-unidirectional displacement switch. The switch 10 comprises first and second contacts 1 and 2 each of which is formed by a conductive plate having a spring characteristic. The first and the second contacts 1 and 2 are adjacent to each other and generally extend in a predetermined direction A0.

The first contact 1 has a first spring portion 11 extending long in the predetermined direction A0, an operating portion 12 extending from one end of the first spring portion 11 and protruding upward to form a convex shape, a contacting base portion 13 extending from the operating portion 12 in the predetermined direction A0, and a first contacting portion 14 extending from one lateral side of the contacting base portion 13. The first contacting portion 14 has an inclined plane or surface 15 obliquely extending from the contacting base portion 13, and a contacting plane or surface 16 extending from the inclined plane 15 upward in a first direction A1 perpendicular to the predetermined direction A0. Each of the first spring portion 11, the operating portion 12, and the contacting base portion 13 has a generally plate-like shape having a sufficient width in a second direction A2 perpendicular to the predetermined direction A0 and the first direction A1. With this structure, the first contacting portion 14 is supported to be movable in the first direction A1 alone. The first spring portion 11 has the other end provided with a first fixing portion 17 to be fixed to an insulator (not shown).

The second contact 2 has a second spring portion 21 extending long in the predetermined direction A0, a planar portion 22 extending from one end of the second spring portion 21, and a guide member 23 obliquely extending from the planar portion 22. A combination of the planar portion 22 and the guide member 23 forms a second contacting portion 25. The second spring portion 21 has a generally plate-like shape having a sufficient width in the first direction A1. With this structure, the second contacting portion 25 is supported to be movable in the second direction A2 alone. The second spring portion 21 has the other end provided with a second fixing portion 26 to be fixed to the insulator, like the first fixing portion 17 mentioned above.

The first and the second spring portions 11 and 21 are arranged adjacent to each other so as to form a generally L-shaped section along a plane perpendicular to the predetermined direction A0. The inclined plane 15 and the guide member 23 are located to be generally in parallel to each other in a direction intersecting with both the first and the second directions A1 and A2 with a space left therebetween. In this state, the first and the second contacts 1 and 2 are separated from each other and the switch 10 is turned off. Each of the first and the second fixing portions 17 and 26 is provided with a terminal portion (not shown) to be connected to an electric wire or an electric circuit.

Figure 4:
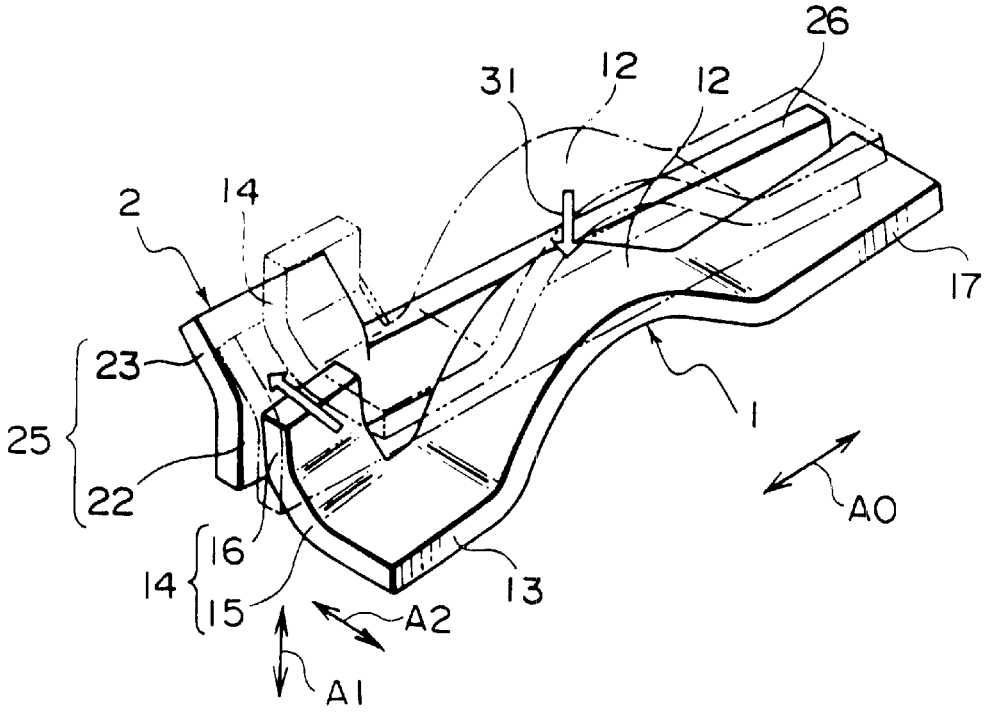
FIG. 4 is a perspective view of the switch illustrated in FIG. 1 after it is operated.

Referring to FIG. 4 in addition to FIGS. 1 through 3, description will be made of an operation of the switch 10.

It is assumed that the operating portion 12 of the first contact 1 is pressed as depicted by a white arrow 31 in FIG. 2. In this event, the inclined plane 15 of the first contacting portion 14 touches an inclined plane defined by the guide member 23 of the second contact 2 to produce a component force in the second direction A2. Specifically, between the first and the second contacting portions 14 and 25, a mutual relationship is established such that, when the first contacting portion 14 is press-contacted by the second contacting portion 25 in the first direction A1, the second contacting portion 25 is applied with the component force in the second direction A2. The component force in the second direction A2 presses and displaces the guide member 23 in the second direction A2 as depicted by a white arrow 32 in FIG. 3. As a result, the second spring portion 21 of the second contact 2 is bent.

Bending the second contact 2, the first contacting portion 14 gradually moves downward along the inclined plane of the guide member 23 so that the contacting plane 16 is brought into contact with a contacting plane of the planar portion 22 of the second contact 2 as illustrated in FIG. 4. In this state, the first and the second contacts 1 and 2 are electrically connected to each other so that the switch 10 is turned on.

After the contacting plane 16 is brought into contact with the planar portion 22, a so-called wiping effect is obtained by frictional contact therebetween. In this state, irrespective of the displacement 3 of the first contacting portion 14, the displacement 4 of the second contacting portion 25 is kept constant. Therefore, even if the bending amount of the contact 1 is great, the bending amount of the second contact 2 is suppressed small. Since the bending amount of the second contact 2 is kept constant, it is possible to keep stable contact between the first and the second contacts 1 and 2.

In the state illustrated in FIG. 2, it is assumed that the pressing force upon the operating portion 12 is removed. Then, due to elastic restoring force of each of the first and the second spring portions 11 and 21, the first contacting portion 14 moves upward while the second contacting portion 25 returns to a predetermined inner position so that the switch 10 is turned off.

According to the switch 10, the bending amount of the first contact 1 is reduced. In addition, the maximum bending amount of the second contact 2 is kept constant and small and an operation space required by the switch 10 can be reduced. The bending movement of the second contact 2 is not affected by the bending amount of the first contact 1. Therefore, the bending amount of the second contact 2 is suppressed to a small value and is kept constant.

Figure 5:
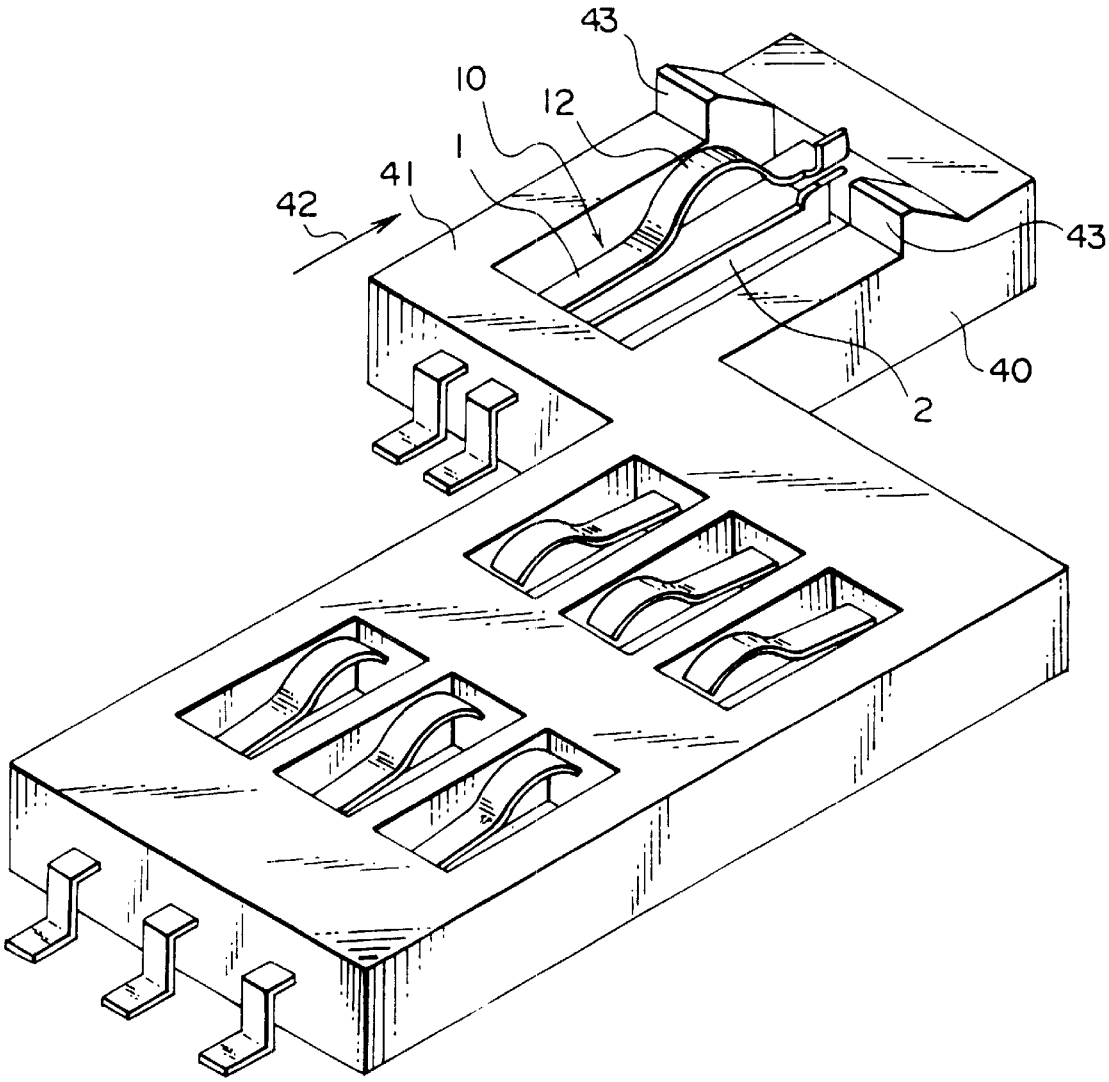
FIG. 5 is a perspective view of a connector using the switch illustrated in FIG. 1.

Referring to FIG. 5, description will be made of a connector using the above-mentioned switch 10.

The connector illustrated in FIG. 5 is an electrical connector or a card socket for connecting an IC card (not shown) and comprises an insulator 40 fixedly holding the switch 10. Specifically, the insulator 40 fixedly holds the first and the second fixing portions 17 and 26 (see FIGS. 1 through 4) of the first and the second contacts 1 and 2.

In the state illustrated in FIG. 5, the switch 10 is turned off. The IC card is loaded in the connector, sliding along an upper surface 41 of the insulator 40 in a direction depicted by an arrow 42 until its forward end is brought into contact with a protrusion 43 formed on the insulator 40. At this time, the IC card presses the operating portion 12 of the first contact 1 downward. Thus, the switch 10 is turned on as described in conjunction with FIGS. 1 through 4. When the IC card is removed, the switch 10 is turned off again.

What is claimed is:

1. A switch comprising a first and a second contact, said first contact including:

a first contacting portion; and a first spring portion supporting said first contacting portion so that said first contacting portion is movable in a first direction alone, said second contact including:

a second contacting portion faced to said first contacting portion in said first direction and adapted to be brought into contact with said first contacting portion; and a second spring portion supporting said second contacting portion so that said second contacting portion is movable only in a second direction intersecting with said first direction, said first and said second contacting portions being in a mutual relationship such that, when said first contacting portion is press-contacted by said second contacting portion in said first direction, said second contacting portion is applied with component force in said second direction.

2. The switch according to claim 1, wherein said first contacting portion has an inclined plane inclined with respect to said first and said second directions and adapted to produce said component force in cooperation with said second contacting portion.

3. The switch according to claim 2, wherein said first contacting portion has a contacting plane adjacent to said inclined plane and adapted to be brought into contact with said second contacting portion in said second direction.

4. The switch according to claim 1, wherein said second contacting portion has an inclined plane inclined with respect to said first and said second directions and adapted to produce said component force in cooperation with said first contacting portion.

5. The switch according to claim 4, wherein said second contacting portion has a contacting plane adjacent to said inclined plane and adapted to be brought into contact with said first contacting portion in said second direction.

6. The switch according to claim 1, wherein said first spring portion has a plate-like shape having a substantial width in a direction perpendicular to said first direction.

7. The switch according to claim 1, wherein said second spring portion has a plate-like shape having a substantial width in a direction perpendicular to said second direction.

8. The switch according to claim 1, wherein said first contact has an operating portion coupled to said first contacting portion and supported by said second spring portion.

9. A connector comprising the switch according to claim 1 and an insulator supporting said switch.

10. A switch comprising a first and a second contact which are adjacent to each other and extend in a predetermined direction, said first contact including:

a first spring portion formed into a generally plate-like shape; and a first contacting portion to be brought into contact with said second contact, said second contact including:

a second spring portion formed into a generally plate-like shape; and a second contacting portion to be brought into contact with said first contacting portion, said first and said second spring portions being arranged adjacent to each other so as to have a generally L-shaped section along a plane perpendicular to said predetermined direction, said first contacting portion being displaced in a first direction intersecting with said predetermined direction to press said second contacting portion so that said second contacting portion is displaced in a second direction intersecting with said predetermined direction and said first direction, said first and said second contacting portions being brought into frictional contact with each other during the displacement.

11. The switch according to claim 10, wherein said first contacting portion having a protrusion portion protruding in a direction intersecting with said second direction so as to press and displace said second contacting portion in said second direction when said first contacting portion is brought into contact with said second contacting portion, said second contacting portion having a planar portion extending from said second spring portion and a guide member obliquely extending from a lateral side of said planar portion, said guide member guiding said first contacting portion to said planar portion in frictional contact therewith upon contacting said protrusion portion of the first contacting portion, said first contacting portion and said planar portion being brought into contact with each other in said second direction.

12. The switch according to claim 10, wherein said first and said second spring portions are bent in directions different from each other.

13. A connector comprising a switch as claimed in claim 10 and an insulator holding said switch.

* * * * *